US005820001A

United States Patent [19]

Soros

[11] Patent Number: 5,820,001

[45] Date of Patent: Oct. 13, 1998

[54] HATCHET SCABBARD

[75] Inventor: Charles C. Soros, Seattle, Wash.

[73] Assignee: Spencer Products Co., Seattle, Wash.

[21] Appl. No.: 744,535

[22] Filed: Nov. 6, 1996

[51] Int. Cl.[6] ..... A45F 5/14

[52] U.S. Cl. ..... 224/234; 224/232; 224/236; 224/684; 224/904; 206/349; 30/298.4; 150/161

[58] Field of Search ..... 224/234, 235, 224/236, 237, 240, 676, 677, 681, 682, 683, 684, 904; 150/161; 206/349, 234, 375; 2/247, 250, 252, 253; 30/151, 308.1, 298.4; D3/219, 220, 265

[56] References Cited

U.S. PATENT DOCUMENTS

| | | | |
|---|---|---|---|
| D. 291,627 | 9/1987 | Collins | D3/220 |
| D. 323,744 | 2/1992 | Casale | 224/240 |
| 1,633,319 | 6/1927 | Estwing | 224/234 |
| 1,821,258 | 9/1931 | Clark | 224/234 |
| 1,928,063 | 9/1933 | Lehmann | 224/234 |
| 2,324,194 | 7/1943 | Campiglia | 224/236 |
| 3,130,883 | 4/1964 | MacKool | 224/232 |
| 3,473,712 | 10/1969 | Genchi | 224/234 |
| 3,537,108 | 11/1970 | Daniels | 2/252 |
| 3,854,639 | 12/1974 | Genchi | 224/234 |
| 4,420,104 | 12/1983 | DiIenno | 224/250 |
| 4,441,639 | 4/1984 | Craw et al. | 224/237 |
| 4,726,498 | 2/1988 | Esposito | 224/232 |
| 4,773,577 | 9/1988 | Mikula | 224/234 |
| 4,779,655 | 10/1988 | Olson | 150/134 |
| 4,966,321 | 10/1990 | Outlaw | 224/674 |
| 5,201,447 | 4/1993 | Bumb et al. | 224/243 |
| 5,374,919 | 12/1994 | Zelka et al. | 224/683 |
| 5,395,023 | 3/1995 | Naymark et al. | 224/240 |
| 5,409,153 | 4/1995 | Ristich | 224/236 |
| 5,431,318 | 7/1995 | Garcia | 224/658 |
| 5,509,147 | 4/1996 | Busquets | 2/253 |

FOREIGN PATENT DOCUMENTS

| | | | |
|---|---|---|---|
| 2634633 A1 | 2/1990 | France | 224/240 |

*Primary Examiner*—Henry J. Recla
*Assistant Examiner*—Gregory M. Vidovich
*Attorney, Agent, or Firm*—Christensen, O'Connor, Johnson & Kindness PLLC

[57] ABSTRACT

A scabbard (14) for firefighters and other types of hatchets (19) is disclosed. The scabbard (41) includes a belt (45) and a sheath (43). The sheath (43) has two pockets, a closed pocket (47) and an openable pocket (49). The entrances into the pockets face one another, i.e., the entrance into the closed pocket faces the entrance into the openable pocket. The edges of the sides of the closed pocket (47) are permanently affixed to one another. In contrast, the forward and upper edges of the sides of the openable pocket (49) are joined by Velcro™ closure elements (65*a*, 65*b*, 67*a*, 67*b*). The inner and outer sides of the openable pocket are integrally joined along their lower edges. The inner sides of the closed and openable pockets are also unitary. Further, the outer side of the openable pocket overlaps the outer side of the closed pocket. The overlap is joined by Velcro™ closure elements (69*a*, 69*b*) Finally, a tab (71) attached to the outer side of the openable pockets extends rearwardly from the Velcro™—connected overlap. In operation, pulling the tab (71), releases the Velcro™ closure elements, allowing the hatchet head (11) to be removed from the sheath (43) by moving the hatchet (9) forward in a horizontal direction.

24 Claims, 2 Drawing Sheets

HATCHET SCABBARD

FIELD OF THE INVENTION

This invention relates to scabbards and, more particularly, to scabbards for hatchets.

BACKGROUND OF THE INVENTION

A variety of scabbards for attaching a hatchet to the waist of a user have been developed. Hatchet scabbards generally include a sheath for holding the head of a hatchet and a belt for attaching the sheath to the waist of the user. In general, the bottom of the sheath includes a hole through which the handle of the hatchet extends when the scabbard is attached to the waist of a user. Such sheaths require that the hatchet be raised the length of the hatchet handle in order to be removed. This is time-consuming, cumbersome, and undesirable in some circumstances. In this regard, some hatchets are designed for use by firefighters and rescue workers. See, for example, the hatchet described in U.S. patent application Ser. No. 08/806,393,filed Feb. 26, 1997, which has matured into U.S. Pat. No. 5,709 ,031, titled Firefighters Hatchet, inventor, G. J. J. Van Beek. and rescue workers often want rapid and easy access to a hatchet carried in a scabbard. As noted above, the most common prior art hatchet scabbards do not satisfactorily meet this need.

Summary of the Invention

In accordance with this invention, a scabbard for firefighters, rescue workers, and other types of hatchets is provided. The scabbard includes a sheath formed of two pockets, a closed pocket and an openable pocket. The entrances into the pockets face one another. When the sheath is positioned at the side of a user, the closed and openable pockets are horizontally aligned, preferably with the openable pocket in front of the closed pocket. Except for the entrance, the edges of the closed pocket are permanently affixed to one another. In contrast, selective edges of the openable pocket are separable. Separating the edges opens the openable pocket to allow a hatchet head to be removed from the scabbard sheath by moving the hatchet horizontally rather than vertically. This allows the hatchet to be more rapidly and easily removed from the scabbard, when compared to prior art scabbards that require a hatchet to be raised above a hole in the bottom of a sheath.

In accordance with further aspects of this invention, the upper and vertical edges of the openable pocket are joined by a separable mechanism, preferably Velcro™ (hook and loop fastener).

In accordance with further aspects of this invention, the inner and outer sides of the openable pocket are integral along the lower edge of the openable pocket.

In accordance with still other aspects of this invention, the inner or belt side of the closed and openable pockets are integral.

In accordance with still further aspects of this invention, the outer side of the openable pocket overlaps the outer side of the closed pocket. Preferably, the overlap is joined by Velcro™

In accordance with still further aspects of this invention, a tab is attached to the outer side of the openable pocket and overlies the closed pocket when the openable pocket is closed.

In accordance with yet still further aspects of this invention, the inner and outer sides of the closed and openable pockets are formed of a flexible relatively strong material, such as canvas.

As will be readily appreciated from the foregoing description, the invention provides a new and improved scabbard that is ideally suited for use by firefighters and rescue workers. In this regard, while designed for use by firefighters and rescue workers, a scabbard formed in accordance with the invention can be used by others. The scabbard provides two pockets, a closed pocket and an openable pocket. Preferably, the openable pocket is located in front of the closed pocket. One side of the head of the hatchet resides in the closed pocket and the other side is enclosed by the openable pocket. When the openable pocket is open, the hatchet is removed by moving the hatchet in a forward direction, which removes the part of the head of the hatchet residing in the closed pocket from the closed pocket. Preferably, the openable pocket is held closed by Velcro™, which allows the openable pocket to be readily and quickly opened.

BRIEF DESCRIPTION OF THE DRAWINGS

The foregoing features and many of the attendant advantages of this invention will become more readily appreciated as the same becomes better understood by reference to the following detailed description, wherein.

DETAILED DESCRIPTION OF THE PREFERRED EMBODIMENT

While the present invention was designed for use with a firefighter's or rescue worker's hatchet and is described in connection with such a hatchet, it is to be understood that the invention can be used with other types of hatchets.

Figure 1:
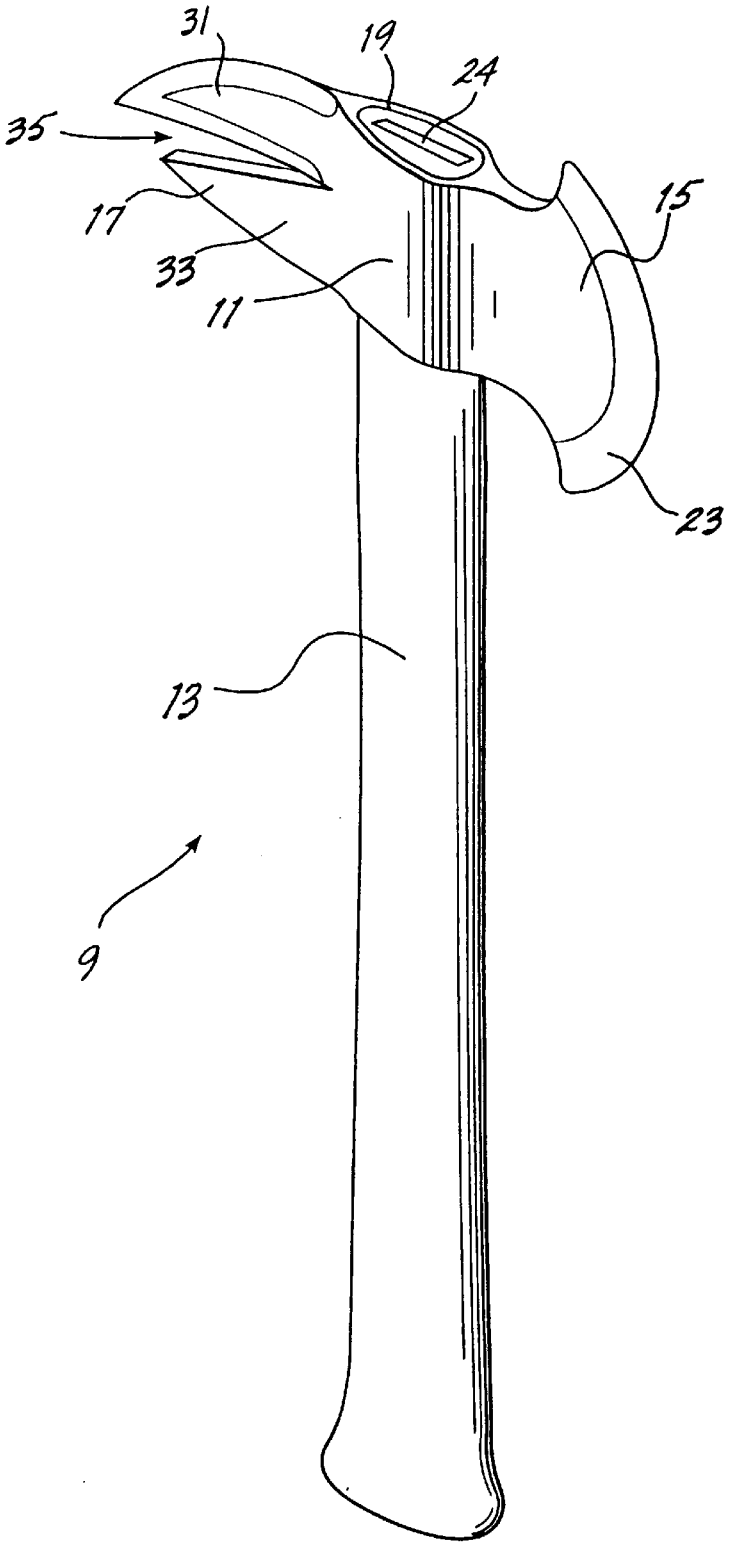
FIG. 1 illustrates a hatchet designed for use by firefighters and rescue workers.

FIG. 1 illustrates a firefighter's or rescue worker's hatchet 9 , which includes a head 11 and a handle 13. While the handle 13 may be formed of any suitable wood, such as hickory, preferably, it is formed of a composite material, i.e., a material comprised of a plurality of suitably oriented fibers embedded in epoxy. The hatchet head 11 is forged of a suitable steel. The hatchet head 11 is generally flat and has a blade side 15 and a cutting side 17. Located in an enlarged region located at the center of the head is a hole 19 sized to receive one end of the handle 13. Preferably, the handle 13 is rigidly held in place in the hole 19 using a conventional retaining device, such as a suitably shaped wedge 24. Both the blade side 15 and the cutting side 17 of the hatchet head 11 are relatively thin. The blade side 15 terminates at a beveled edge 23 having a relatively small radius of curvature. The cutting side 17 of the hatchet head 11 includes an outer tooth 31 and an inner tooth 33. Located between the inner and outer teeth 31 and 33 is a slot 35. Preferably, the peripheral edges of the outer tooth 31 are beveled. For a more detailed description of the firefighters hatchet illustrated in FIG. 1, attention is directed to U.S. patent application Ser. No. 08/806,393, which has matured into U.S. Pat. No. 5,70(,031, referenced more fully above, which is incorporated herein by reference.

Figure 3:
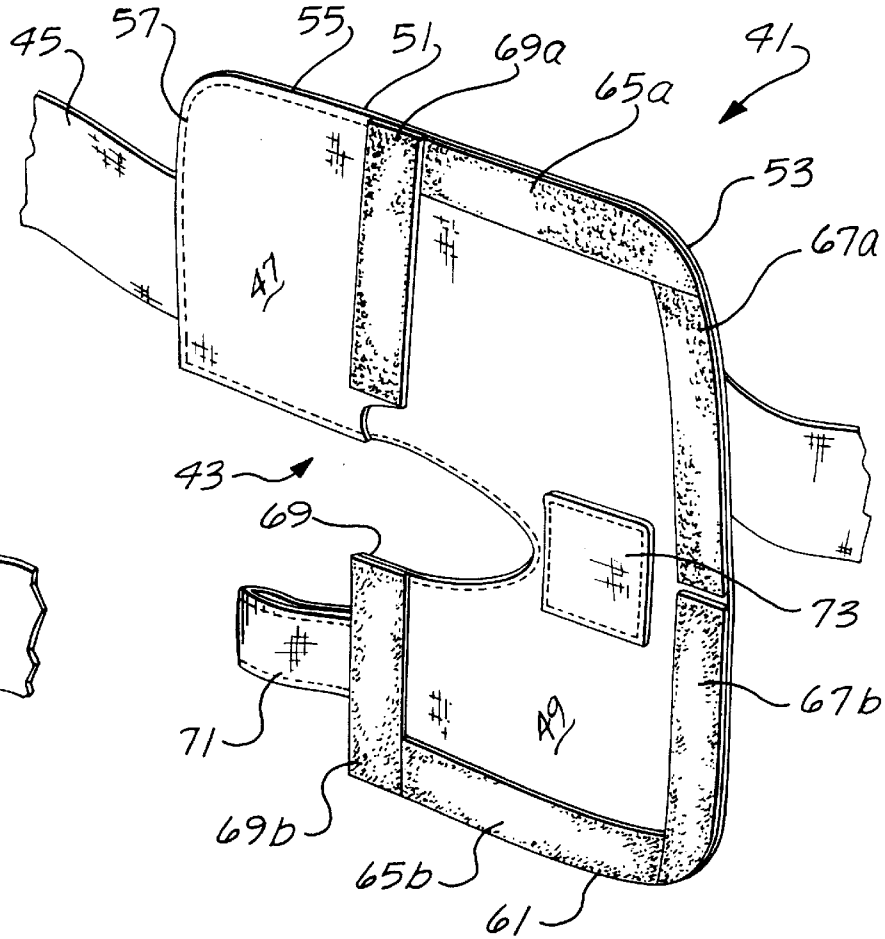
FIG. 3 illustrates a hatchet scabbard formed in accordance with the invention with the openable pocket open.
Figure 2:
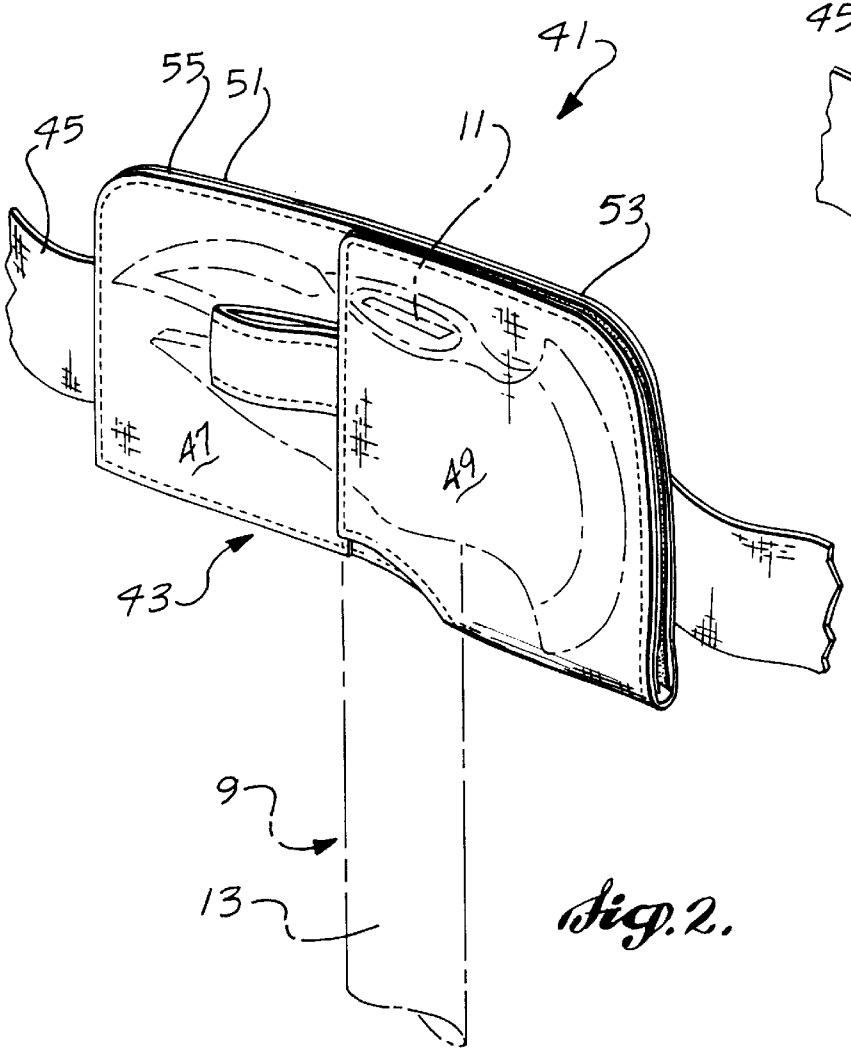
FIG. 2 illustrates a hatchet scabbard formed in accordance with the invention with the openable pocket closed.

FIGS. 2 and 3 illustrate a scabbard 41 formed in accordance with the invention ideally suited for use with a hatchet of the type illustrated in FIG. 1. While the scabbard 41 is ideally suited for use with such a hatchet, as noted above, it is to be understood that the scabbard can also be utilized with other types of hatchets, particularly double-sided hatchets, i.e., hatchets having a cutting blade on both sides.

The scabbard 41 illustrated in FIGS. 2 and 3 includes a sheath 43 and a belt 45. The belt may be dedicated to the scabbard or the normal pants belt of a user. The sheath 43 is formed of a flexible, suitably strong material, such as canvas. The sheath includes a closed pocket 47 and an openable pocket 49. The closed pocket 47 includes an inner side 51 that is integral with the inner side 53 of the openable pocket 49. The closed pocket 47 also includes an outer side 55. The outer side 55 of the closed pocket 47 is permanently attached to the inner side 51 along its upper, lower and outer edges. While stitching is the preferred way of attaching the outer side 55 of the closed pocket to the inner side 51, obviously, other affixation techniques can be utilized. In any event, the open side of the closed pocket 47 faces forward when the scabbard is attached to the side of a user. When so positioned, the closed pocket 47 forms a rear pocket.

In addition to an inner side 53 that is integral with the inner side 51 of the closed pocket 47, the openable pocket 49. includes an outer side 61. One edge of the inner side 53 of the openable pocket 49 is integral with an edge of the outer side 61 of the openable pocket 49. This is the lower edge of both sides when the openable pocket is closed as shown in FIG. 2. The upper edges (when closed) of the inner and outer sides 53 and 61 of the openable pocket include Velcro™ elements 65*a* and 65*b*. Likewise, the forward edge, i.e., the edge of the openable pocket 49 remote from the closed pocket 47, of the inner and outer sides 53 and 61 of the openable pocket include Velcro™ elements 67*a* and 67*b*. As a result, the upper and forward edges of the openable pocket 49 are held closed when the outer side 61 of the openable pocket 49 is aligned with the inner side 53 and the edges of the inner and outer sides are pressed together. Obviously, if desired, an attachment media other than Velcro™ can be used--a series of snaps, for example.

The outer side 61 of the openable pocket 49 includes a flap 69 that overlies the outer forward edge of the closed pocket 47. Velcro™ elements 69*a* and 69*b* are located in the region of overlap. As a result, when the openable pocket 49 is closed, it is also attached to the closed pocket in the overlap region. Again, if desired, an attachment media other than Velcro™ can be used, if desired.

A tab 71 extends rearwardly from the flap 69 of the outer side 61 of the openable pocket 49. Preferably, a reinforcing layer 73 is located in the region where the inner side 53 and the outer side 61 of the openable pocket 49 are integrally joined, i.e., the reinforcing layer is located along the lower end of the openable pocket when the openable pocket is closed.

A hatchet is inserted into the sheath 43 by opening the openable pocket. This is accomplished by pulling the tab 71 outwardly, breaking the Velcro™ attachments that hold the outer side 61 of the openable pocket closed. When free of the Velcro™ attachments, the outer side 61 of the openable pocket swings down to the position shown in FIG. 3. Thereafter, one side of the head of a hatchet is inserted into the closed pocket 47. By way of example, as shown in FIG. 2, the outer and inner teeth 31 and 33 of the cutting side 17 of the head 11 of the hatchet 9 shown in FIG. 1 are inserted into the closed pocket 47. The head 11 of the hatchet 9 is oriented such that the handle 13 of the hatchet extends down. The other side of the head of the hatchet, i.e., the blade side 15, is positioned against the inner side 53 of the openable pocket 49. Thereafter, the outer side 61 of the openable pocket 49 is closed by raising the outer side upwardly and bringing the Velcro™ closure elements together. Pressure causes the VelcroTm™ closure elements to grip one another resulting in the closed sheath shown in FIG. 2.

As will be readily appreciated from the foregoing description, the handle 13 of the hatchet 9 does not need to be lowered through a hole in the scabbard. All that is required is to slide one side of the ax head into the closed pocket and raise the outer side of the openable pocket to a closed position.

The hatchet 9 is removed from the scabbard sheath 43 in the reverse manner. The tab 71 is pulled outwardly, opening the Velcro™ closure elements and allowing the outer side 61 of the openable pocket 49 to drop down, into the position shown in FIG. 3. Thereafter, the hatchet 9 is moved forward, withdrawing the side of the hatchet located in the closed pocket 47 out of the closed pocket. Thereafter, the hatchet is ready for use.

The belt 45 can be connected to the sheath in any suitable manner. For example, the belt 45 can be attached to the sheath 43 using permanent fasteners, such as rivets. Alternatively, the belt 45 can be passed through loops (not shown) located on the outer surface of the inner sides 51 and 53 of the closed and openable pockets 47 and 49 . Alternatively, the belt 45 could be threaded through vertical slits (not shown) located in the inner side 51 and 53 of the closed and openable pockets 47 and 49.

As will be readily appreciated from the foregoing description, the invention provides a new and improved hatchet scabbard. The hatchet scabbard is ideally suited for use by firemen or rescue workers. The scabbard is easily opened, allowing the head of a hatchet to be quickly removed for use. Rather than raising a hatchet upwardly during removal until the handle of the hatchet lies above a hole in the bottom of a scabbard sheath, the scabbard sheath includes an openable pocket that can be quickly and easily opened. While the scabbard was designed for use with a firefighter's and rescue worker's hatchet of the type illustrated in FIG. 1, it is to be understood that the scabbard can be used with other types of hatchets. Consequently, within the scope of the appended claims, it is to be understood the invention can be practiced otherwise than is specifically described herein.

The embodiments of the invention in which an exclusive property or privilege is claimed are defined as follows:

1. A hatchet scabbard comprising:

a belt; and a sheath attached to said belt, said sheath including a closed pocket having an entrance and sides and an openable pocket having an entrance and sides, said closed pocket and said openable pocket lying in substantially the same plane, said entrances of said closed pocket and said openable pocket positioned such that the entrance into the closed pocket faces the entrance into the openable pocket, said sides of said closed pocket and said openable pocket having edges, the edges of the sides of said closed pocket being permanently joined to one another, selective edges of the sides of the openable pocket being separable.

2. The hatchet scabbard claimed in claim 1, wherein two of the edges of the openable pocket are separable.

3. The hatchet scabbard claimed in claim 2, wherein the separable edges of the openable pockets are joined by a hook and loop fastener.

4. The hatchet scabbard claimed in claim 3, wherein the sides of the openable pocket are integral with one another along an edge that is not separable.

5. The hatchet scabbard claimed in claim 4, wherein one side of the closed and openable pockets are integral with one another.

6. The hatchet scabbard claimed in claim 5, wherein the side of the openable pocket that is not integral with the side of the closed pocket overlaps the closed pocket.

7. The hatchet scabbard claimed in claim 6, wherein the overlap is joined by a hook and loop fastener.

8. The hatchet scabbard claimed in claim 7, including a tab attached to the overlapping region of the openable pocket.

9. The hatchet scabbard claimed in claim 1, wherein one side of the closed and openable pockets are integral with one another.

10. The hatchet scabbard claimed in claim 9, wherein the side of the openable pocket that is not integral with the side of the closed pocket overlaps the closed pocket.

11. The hatchet scabbard claimed in claim 10, wherein the overlap is joined by a hook and loop fastener.

12. The hatchet scabbard claimed in claim 11, including a tab attached to the overlapping region of the openable pocket.

13. A sheath for a hatchet head, said sheath comprising:

a closed pocket having an entrance and sides; and an openable pocket having an entrance and sides, said closed pocket and said openable pocket lying in substantially the same plane, said closed pocket and said openable pocket positioned such that the entrance into the closed pocket faces the entrance into the openable pocket, said sides of said closed pocket and said openable pocket having edges, the edges of the sides of the closed pocket being permanently joined to one another, selective edges of the openable pocket being separable.

14. The sheath claimed in claim 13, wherein two of the edges of the openable pocket are separable.

15. The sheath claimed in claim 14, wherein the separable edges of the openable pockets are joined by a hook and loop fastener.

16. The sheath claimed in claim 15, wherein the sides of the openable pocket are integral with one another along an edge that is not separable.

17. The sheath claimed in claim 16, wherein one side of the closed and openable pockets are integral with one another.

18. The sheath claimed in claim 17, wherein the side of the openable pocket that is not integral with the side of the closed pocket overlaps the closed pocket.

19. The sheath claimed in claim 18, wherein the overlap is joined by a hook and loop fastener.

20. The sheath claimed in claim 19 , including a tab attached to the overlapping region of the openable pocket.

21. The sheath claimed in claim 13, wherein one side of the closed and openable pockets are integral with one another.

22. The sheath claimed in claim 21, wherein the side of the openable pocket that is not integral with the side of the closed pocket overlaps the closed pocket.

23. The sheath claimed in claim 22, wherein the overlap is joined by a hook and loop fastener.

24. The sheath claimed in claim 23, including a tab attached to the overlapping region of the openable pocket.

* * * * *